US007118245B1

(12) United States Patent
Herrington

(10) Patent No.: US 7,118,245 B1
(45) Date of Patent: Oct. 10, 2006

(54) TRAINMAN'S LANTERN

(76) Inventor: Allen Herrington, 3405 Marion Pl., Greenbanks, WA (US) 98253

( * ) Notice: Subject to any disclaimer, the term of this patent is extended or adjusted under 35 U.S.C. 154(b) by 45 days.

(21) Appl. No.: 10/842,782

(22) Filed: May 11, 2004

(51) Int. Cl.
*F21L 4/00* (2006.01)
*F21V 29/00* (2006.01)
*B60Q 1/06* (2006.01)

(52) U.S. Cl. ..... 362/185; 362/294; 362/373

(58) Field of Classification Search ..... 362/185, 362/188, 294, 373, 345, 184, 190, 191; 246/433
See application file for complete search history.

(56) References Cited

U.S. PATENT DOCUMENTS

| | | | | | |
|---|---|---|---|---|---|
| 1,925,115 | A * | 9/1933 | Seiss | 362/197 |
| 2,726,321 | A * | 12/1955 | Riotto | 362/184 |
| 2,915,744 | A * | 12/1959 | Lewis | 340/321 |
| 5,001,612 | A * | 3/1991 | Odlum | 362/187 |
| 5,929,788 | A * | 7/1999 | Vukosic | 340/908.1 |
| 6,135,612 | A * | 10/2000 | Clore | 362/184 |
| 6,296,369 | B1 * | 10/2001 | Liao | 362/186 |
| 6,454,433 | B1 * | 9/2002 | Alessio | 362/157 |
| 6,483,439 | B1 * | 11/2002 | Vukosic | 340/815.65 |
| D486,932 | S * | 2/2004 | Dario et al. | D26/40 |
| 6,841,941 | B1 * | 1/2005 | Kim et al. | 315/86 |
| 2004/0125598 | A1 * | 7/2004 | Bryce | 362/161 |
| 2004/0188468 | A1 * | 9/2004 | Lebowitz | 222/189.07 |

OTHER PUBLICATIONS

"Star Model 292 Trainman's Lanterns User Instruction Guide" Star Headlight & Lantern Co., Inc.

"With Tongues of Fire": Railroad Lanterns By Bill Knapke—Railroad Magazine, Jan. 1953—(Reprinted by Railroadiana online Website).

* cited by examiner

*Primary Examiner*—Renee Luebke
*Assistant Examiner*—Evan Dzierzynski
(74) *Attorney, Agent, or Firm*—Todd N. Hathaway

(57) ABSTRACT

A trainman's lantern having a reflector that produces both a main beam and secondary illumination for signaling purposes. The reflector includes inner and outer reflective surfaces. An incandescent bulb mounted centrally within the reflector produces the concentrated main beam. A plurality of LEDs mounted around the exterior of the reflector form beams that are reflected outwardly by the outer reflective surface to produce the secondary illumination. Ports in the reflector allow light from the primary bulb to pass outwardly therethrough in a lateral direction so as to augment the light of the LEDs. A transparent housing is mounted around the reflector and LEDs. The housing and reflector are mounted to the lower end of a battery case having a bail for holding the lantern in horizontal or vertical orientations. The combination of the LEDs and incandescent main bulb reduces draw on the battery. The bail has straight leg portions that are gripped when holding the lantern horizontally, and an upwardly curved bow portion that is suspended from the fingers of a hand when the lantern is held in a vertical orientation.

16 Claims, 4 Drawing Sheets

TRAINMAN'S LANTERN

BACKGROUND a. Field of the Invention

The present invention relates generally to signaling lanterns used in the railroad industry, and, more particularly, to a trainman's lantern having both axially and radially directed illumination.

b. Prior Art

Trainman's lanterns are specialized lighting apparatus used in the railroad industry for purposes of both signaling and illumination.

In particular, trainman's lanterns are used to transmit signals from the brakeman or switchman to the engineer in the locomotive, when coupling/uncoupling cars, moving on to switches and sidings, and so on. Modern lanterns have their origins in the oil lanterns of the 19th century, and so many of the signals now in use (e.g., swinging the lantern through an arc with the arm lowered) were developed on this basis, with the limitation that the lantern needed to held generally upright. Still other signals evolved with the later adoption of electric lanterns. Furthermore, in addition to signaling, the trainman's lantern must provide general purpose illumination in order for the brakeman to read numbers and information on the cars, to see when walking on the crushed rock ballast, and so on.

This combination of functions has given rise to certain design requirements. First, the lantern must project a degree of illumination in a lateral direction that will be visible to the engineer when the lantern is held/swung in a vertical orientation. It must also have a concentrated "spot" beam that can be used for other signaling as well as for general purpose illumination. Furthermore, the lantern is generally required to have a bail-shaped handle that will not only allow it to be swung from side-to-side as described above, but which will also allow it to be carried over a long shift without excessive fatigue.

One example of a previous trainman's lantern having these characteristics is the Starlite™ model 292, available from Star Headlight & Lantern Company, Honeoye Falls, N.Y., USA. This lantern has a battery case that is supported from a bail, with two incandescent bulbs being mounted at the lower end of the case. The first bulb is mounted within a small parabolic reflector covered by a clear shield, similar to a conventional flashlight. The second bulb protrudes from the end of the case and is exposed so that it can be seen from the sides; a ring projects below the case on struts to protect the exposed bulb from damage.

Although they meet the foregoing requirements (i.e., illumination and signaling) in a general sense, prior lanterns of this type have not been wholly satisfactory. The single exposed bulb is non-directional, and when viewed from the side is inadequately bright to be seen by the engineer at long distances (e.g., at the end of a long train, or "consist"); moreover, at certain angles light from the bulb is blocked by the protective struts. However, using additional bulbs for greater brightness and visibility is not a viable solution due to increased drain on the battery: The lanterns are often kept lit throughout nighttime hours, so that using additional bulbs would mean that in many instances the battery would be dead before the end of the shift. Even with existing two-bulb lanterns, each operating region of a major railroad consumes several thousand batteries every night, at considerable cost.

Other deficiencies of traditional trainman's lanterns include a weak and poorly distributed main "spot" beam and inadequate durability: for example, the struts that support the guard ring around the bottom of the lantern described above must be relatively narrow in order to avoid even worse blockage of the bulb, so that the protective cage is relatively fragile and is smashed with alarming regularity.

Accordingly, there exists a need for a trainman's lantern that provides effective, 360° lateral illumination for signaling when held in a vertical orientation. Furthermore, there exists a need for such a trainman's lantern that provides such illumination with sufficient brightness that is visible at extended distances. Still further, there exists a need for such a lantern that provides such illumination without excessive battery drain. Still further, there exists a need for such a lantern that provides a bright, well-distributed main, "spot" beam for purposes of both illumination and signaling. Still further, there exists a need for such a trainman's lantern that is durable and resistant to breakage in normal operating conditions.

SUMMARY OF THE INVENTION

The present invention has solved the problems cited above, and is a trainman's lantern that comprises, broadly, a reflector comprising inner and outer reflective surfaces, a primary light source mounted internal to the reflector so that light from the primary light source is reflected by the inner reflective surface so as to project in a generally axial direction from the reflector, and at least one secondary light source mounted external to the reflector so that light from the secondary light source is reflected by the outer reflective surface so as to project in a generally lateral direction from the lantern.

The inner reflective surface of the reflector may have a generally concave curvature so that light from the primary light source is reflected in a relatively concentrated beam, and the outer reflective surface may have a generally convex curvature so that the light from the at least one secondary light source is reflected in a relatively dispersed pattern.

The at least one secondary light source may comprise at least one LED having a beam that is directed towards the outer reflective surface of the reflector so as to be reflected in the lateral direction therefrom. The secondary light source may comprise a plurality of the LEDs that are mounted at spaced locations around the reflector so that light therefrom is reflected in a substantially radial pattern around the lantern.

The reflector may comprise at least one port formed in the reflector that permits light from the primary source to pass therethrough in the lateral direction so as to augment the light from the at least one secondary source. The reflector may comprise a plurality of the ports formed in the reflector at spaced locations intermediate the LEDs.

The primary light source may comprise an incandescent bulb that is mounted centrally in the reflector approximately level with the ports therein.

The lantern may further comprise a substantially transparent housing that is mounted around a lateral side of the reflector so as to enclose the LEDs and outer reflective surface of the reflector therein. A plurality of lenses may be mounted in the ports in the reflector so as to spread light passing therethrough outwardly against and through the transparent shell. The transparent shell may comprise surface texturing for diffusing the light passing therethrough.

The inner reflective surface of the reflector may comprise a substantially parabolic reflective surface. The inner reflective surface may further comprise a non-faceted zone proximate the centrally mounted incandescent bulb for forming a concentrated central beam, and a faceted zone spaced outwardly from the bulb for forming a distributed illumination around a central beam.

The lantern may further comprise a battery case having the reflector mounted to a lower end thereof in substantially coaxial relationship.

A bail may be mounted to the battery case for holding the lantern alternately in a horizontal or vertical orientation. The bail may comprise first and second substantially straight, parallel lower leg portions for being gripped in a hand when the lantern is held in a horizontal orientation, and a substantially curved upper bow portion spanning the leg portions for being suspended from the fingers of a hand when the lantern is held in a vertical orientation.

The bail may further comprise first and second substantially flattened arm portions at lower ends of the leg portions that angle inwardly towards the battery case so as to provide a thumb rest for steadying the lantern when the lantern is held in a horizontal orientation. The bail may further comprise a cushioning, thermally insulative sleeve that is mounted over at least one of the straight leg portions so as to form an enlarged handgrip for holding the lantern in a horizontal orientation.

In a preferred embodiment, the invention provides a trainman's lantern comprising: (a) a battery case, (b) a projector assembly mounted to a lower end of the battery case in substantially coaxial relationship therewith, the projector assembly comprising: (i) a dome-shaped reflector, comprising a generally concave inner reflective surface and a generally convex outer reflective surface, and a plurality of ports formed at angularly-spaced locations, each of the ports having a lens mounted therein for spreading light passing outwardly therethrough, (ii) a substantially transparent housing mounted circumferentially around the reflector so as to surround the outer reflective surface thereof, (iii) an incandescent bulb mounted centrally within an interior of the reflector so that light from the bulb is reflected form the inner reflective surface so as to form a relatively concentrated main beam that is projected generally axially from a lower end of the lantern, the bulb being mounted approximately level with the ports in the reflector so that the light therefrom passes through the lenses in the ports and outwardly against and through the transparent housing, and (iv) the plurality of LEDs mounted at angularly spaced locations around an exterior of the reflector so that light from the LEDs is reflected from the outer reflective surface of the reflector and through the transparent housing so as to form a secondary illumination that is projected generally laterally and radially from the lower end of the lantern, and (c) a bail mounted to the battery case for selectively holding the lantern in a vertical or horizontal orientation for alternately signaling a locomotive engineer with the main beam or the secondary illumination of the lantern.

These and other features and advantages of the present invention will be more fully understood from a reading of the following detailed description with reference to the accompanying drawings.

DETAILED DESCRIPTION a. Overview

Figure 1:
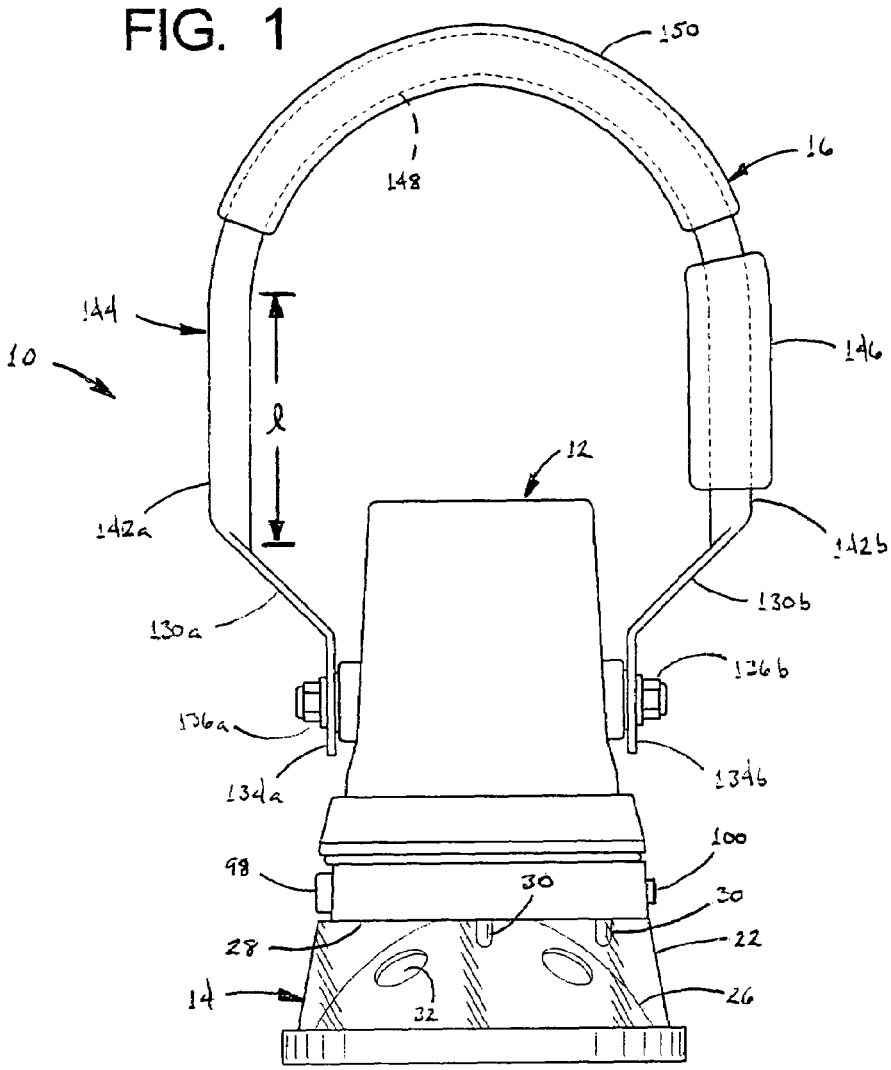
FIG. 1 is a side, elevational view of a trainman's lantern in accordance with the present invention, showing the overall configuration of the apparatus and of the projector assembly at the base of the lantern.

FIG. 1 shows a trainman's lantern 10 in accordance with the present invention. As can be seen, this includes a battery case 12 having a projector assembly 14 mounted to its lower end. The battery case and projector assembly are supported from a bail 16 by which the lantern is carried and manipulated during use, as will be described in greater detail below.

Figure 2:
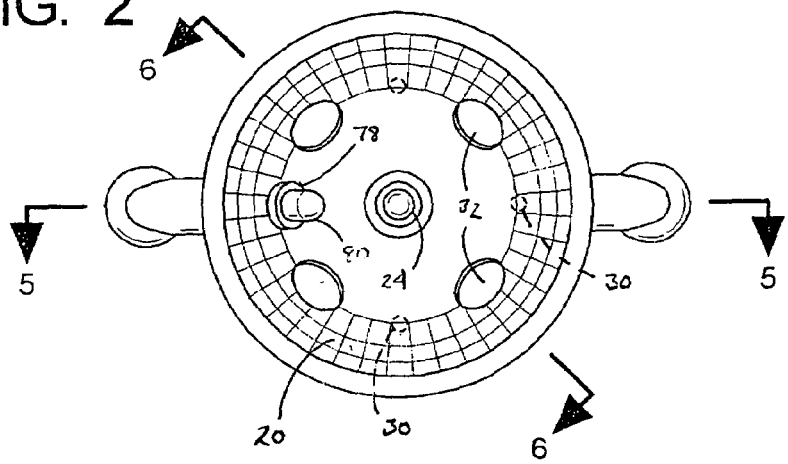
FIG. 2 is a bottom, plan view of the trainman's lantern of FIG. 1, showing the bulb and reflector of the projector assembly that generate the main beam of the lantern.

As can be seen in FIGS. 1–2, the projector assembly 14 includes a large parabolic reflector 20 that is directed axially from the assembly, and a circumferential signal housing 22. An incandescent primary bulb 24 is mounted centrally within the reflector, so that when illuminated this cooperates with the reflector to produce a bright, generally axially directed main beam. The parabolic reflector 20 is substantially centered with respect to the lower end of the battery case, and is formed as a thin-walled shell having a domed back surface 26. The signal housing 22, in turn, is formed of a clear, somewhat frustoconical shell that surrounds the rear side of the reflector so as to define an annular cavity 28. A plurality of LEDs 30 are mounted within the cavity, and are aligned to project their beams downwardly against the back surface 26 of the reflector, so that the beams are reflected outwardly therefrom through the signal housing so to form a generally radially-projecting illumination. The radial illumination of the LEDs is supplemented by light from the main bulb 24 that passes through ports or window openings 32 in the reflector.

The projector assembly 14 thus creates a bright, radially-projecting illumination that is readily visible when signaling at long distances, as well as a powerful main beam that projects axially from the assembly for both signaling and general purpose illumination.

Figure 3:
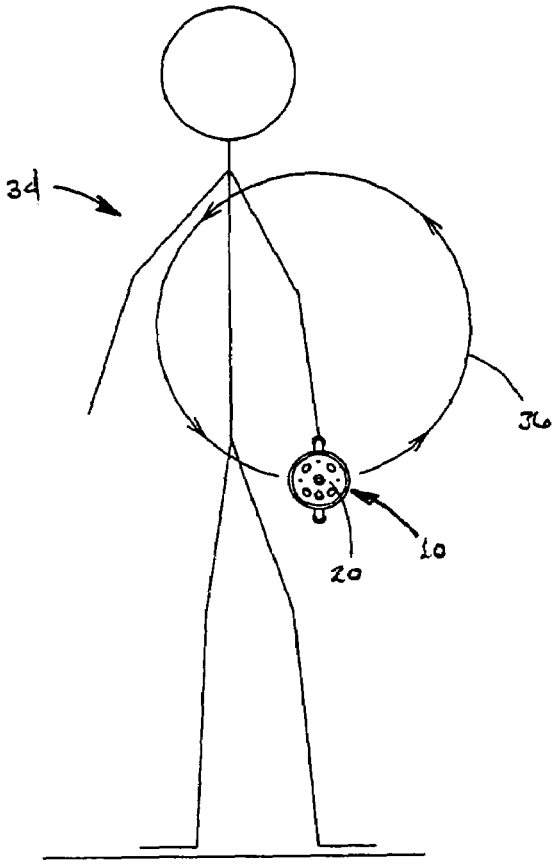
FIG. 3 is an elevational, environmental view of the trainman's lantern of FIGS. 1–2, showing the manner in which the axial main beam of the lantern is employed to produce a signal with the lantern held in a horizontal orientation so that the main beam is visible to the engineer.
Figure 4:
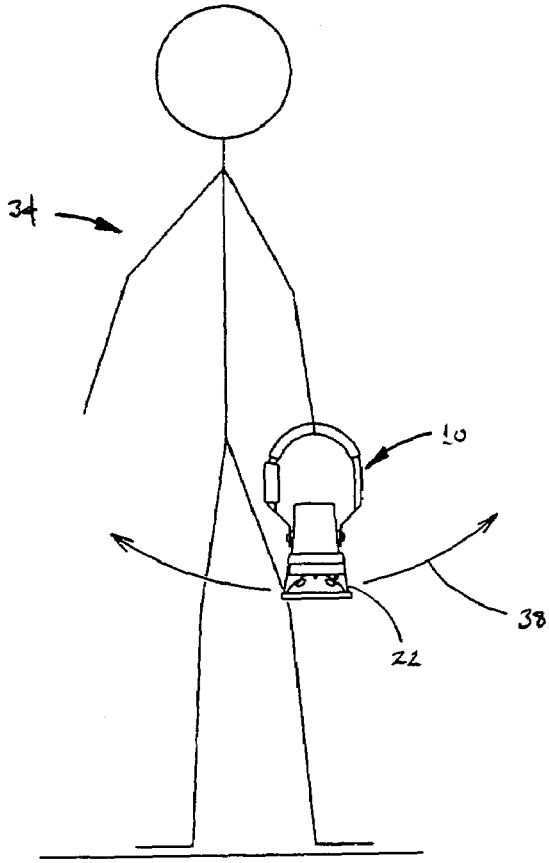
FIG. 4 is an elevational, environmental view, similar to FIG. 3, showing the manner in which the lateral illumination of the lantern is employed to produce a signal with the lantern held in a vertical orientation so that the lateral illumination is visible to the engineer.

Therefore, as can be seen in FIG. 3, the main beam can be used to produce a first set of signals, by the operator 34 holding the lantern in a horizontal orientation and moving it in accordance with a predetermined pattern, e.g., along a circular path as indicated by arrows 36. To produce other signals, the lantern can be held in a vertical orientation as shown in FIG. 4 and moved in accordance with other predetermined patterns, e.g., swung through an arc as indicated by arrows 38. The bright main beam can also be used for reading car numbers and so on, and for illuminating one's path when walking. Moreover, the two illumination patterns are produced using only a single incandescent bulb in combination with LEDs; because of the low current draw of the latter, the increase in performance is accompanied by longer battery life as compared with conventional two-bulb lanterns.

b. Projector Assembly

Figure 5:
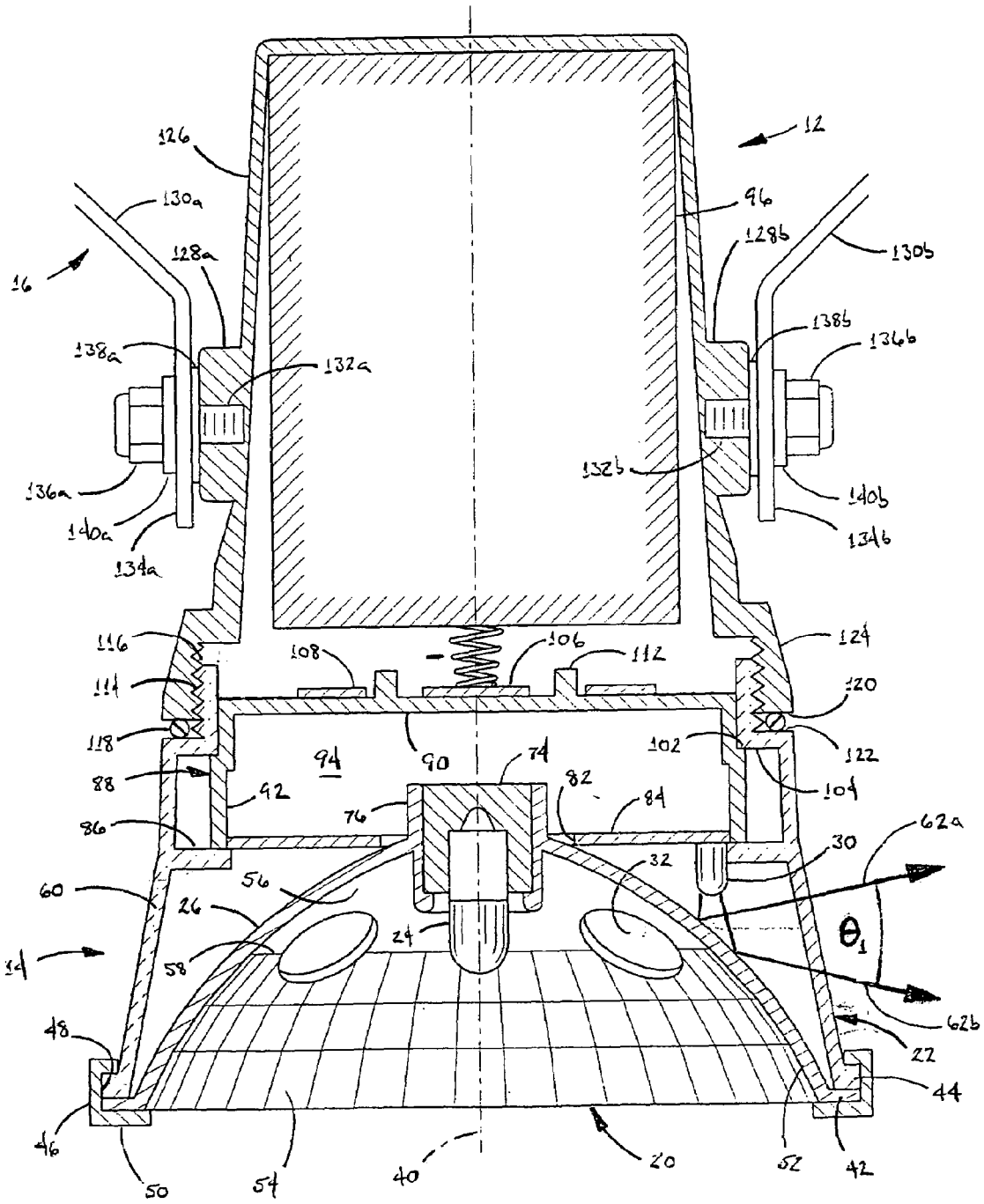
FIG. 5 is a cross-sectional view of the trainman's lantern of FIG. 1, taken along line 5—5 in FIG. 2, showing the reflector of the projection assembly and the relationship of the central bulb and LEDs thereto in greater detail.
Figure 6:
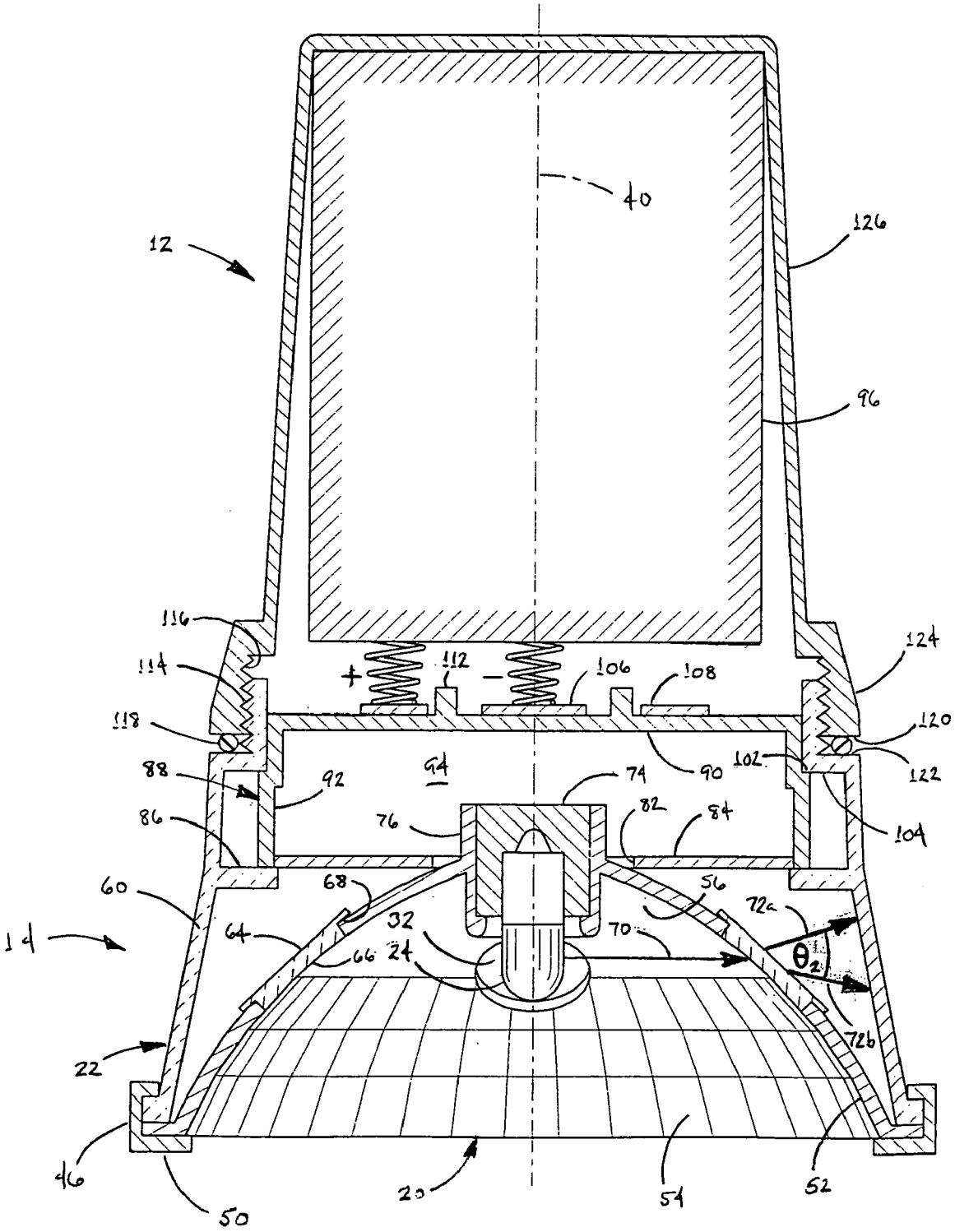
FIG. 6 is a cross-sectional view, similar to FIG. 5, taken along line 6—6 in FIG. 2, showing the relationship of the central bulb to the port openings in the reflector and also the lens units that are mounted in the openings for distributing the light that passes therethrough.

FIGS. 5–6 show the projector assembly 14 in greater detail.

As noted above, the reflector 20 is centered on the main axis 40 of the lantern assembly, so as to project the main beam in an axial direction. The reflector preferably has a parabolic configuration, which produces a strongly axial main beam, although non-parabolic reflectors may be used in some embodiments.

The opening of the reflector spans the entire bottom of the projector assembly, and has a radially-projecting lip 42 that is joined in face-to-face abutment with a corresponding flange 44 on the signal housing 22, by means of an external rubber gasket 46 having a groove 48 in which the two flanges are received so as to be biased together. The lower face 50 of the rubber gasket forms a flat, circular base ring about the lower perimeter of the assembly. The resilient material of the base ring protects the lower edge of the assembly from impact damage and also stabilizes it against sliding when placed on a surface. Furthermore, the diameter of the reflector (and therefore that of the base of the assembly) is preferably somewhat larger than that of the battery case (e.g., the reflector has a diameter of about 4–5 inches in the illustrated embodiment, as against a diameter of about 3.25 inches for the battery case) to help stabilize the assembly against tilting or tipping over.

The reflector 20 is reflective (e.g., "silvered") on both its front and back surfaces 52, 26. The front surface is divided into faceted and non-faceted zones 54, 56. As can be seen in FIGS. 5–6, the non-faceted zone lies in the base area of the reflector, near the bulb 24, and transitions to the faceted zone at a border 58 that is approximately level with the bulb and the windows 32. The non-faceted zone thus forms a bright, concentrated central beam that is distinctly visible to the engineer over long distances when signaling with the lamp in a horizontal orientation, as shown in FIG. 3, as well providing a bright "spot" beam for reading and viewing objects at a distance. The faceted zone 54, in turn, creates a more dispersed illumination in an annular pattern around the central beam, so as to provide broader lighting of objects closer at hand and improved illumination around the operator's feet while walking with the lantern held in a vertical orientation.

The reflective back surface 26 of the reflector, in turn, serves to direct the light from the LEDs 30 outwardly through the transparent wall 60 of the signal housing 22. As is well known, LEDs project light in a more-or-less confined beam, as opposed to the omni-directional projection of conventional, filament-type incandescent bulbs; for example, commercially available LEDs have beam angles ranging from about 8° to about 140°, common examples being 15°, 30° and 45°. Since the light output of LEDs is essentially fixed for a given voltage, however, the brightness ordinarily varies with the width of the beam, i.e., narrow beams tend to be brighter while wide beams tend to be dimmer. LEDs having a beam angle of about 30° are eminently suitable for use in the present invention, striking a satisfactory balance between distribution and brightness; it will be understood, however, that LEDs having other viewing angles may be employed as well, with those in the range from about 15° to about 45° generally being satisfactory.

As can be seen in FIG. 5, the LEDs 30 are mounted so that their beams project downwardly against the rear face 26 of the reflector, along paths generally parallel to the main axis 40 of the assembly. From face 26 they are reflected and redirected generally normal to the axis 40, so that they pass radially outwardly through the transparent wall 60 of the signal housing as indicated by arrows 62*a*, 62*b* in FIG. 5. The angle of the LED beams and the curvature of the reflector face 26 cooperate to create an illumination that extends through a vertical angle $\theta_1$, so that the light is visible to the engineer at a wide range of elevations relative to the lantern.

As noted above, a plurality of LEDs (three LEDs in the illustrated embodiment) are mounted at angularly spaced locations around the perimeter of the assembly, so that at least one LED is visible at any point in a 360° arc around the signal housing. Moreover, the plastic wall 60 of the signal housing is provided with a fine-grained texturing (e.g., a light "pebble" texturing) that diffuses the beams slightly so that the spaces between the LEDs are more evenly lit, creating a more uniform visual signature that aids the engineer in correctly interpreting the signal. Although it may be formed on either side, the texturing is preferably formed on the outer surface of the wall 60 so as to minimize the effects of scratching and other wear and also render the assembly easier to grip and handle.

The light provided by the LEDs 30 is augmented by that from the main bulb 24. As can be seen in FIG. 6, the openings of the reflector windows 32 are formed approximately level with the filament of the bulb. Each of the window openings is fitted with a lens 64 having a concavely curved inner surface 66 that faces towards the bulb. The lenses are suitably formed as small discs of clear plastic having radial flanges 68 that are mounted to the reflector shell by adhesive or other suitable means.

Light from the main bulb 64, as indicated by arrow 70, passes through the clear lenses and is spread across the transparent wall of the signal housing at an increased angle $\theta_2$, as indicated by arrows 72*a*, 72*b*. The light of the main bulb thus augments that of the LEDs to create a brighter, more easily seen radial illumination. Moreover, this is accomplished without the use of a second incandescent bulb that would increase battery drain beyond acceptable levels. The losses to the main beam caused by the individual windows or ports are minimal, and are acceptable in view of the increased brightness and visibility that are produced by the reflector by virtue of the features described above; it will be understood however, that in some embodiments a continuous opening or transparent band may be used rather than individual openings. Suitable dimensions for the window lenses in the ports are a diameter of about ¾ inch and a thickness of about 3/16-inch, with the outer surface being substantially planar and the inner surface having a concave radius of about 1.5-inches.

The main bulb 24 is received in a receptacle 74 having suitable electrical contacts (not shown), which is retained in a socket 76 that is centrally located at the base of the reflector 20. The reflector also includes a rubber grommet 78 (see FIG. 2) that retains a spare bulb 80 at a location where it is readily accessible in the event that the main bulb fails during use. Both the main and spare bulbs are protected from impact damage by the depending lip of the reflector 20, obviating the need for a projecting cage or other dedicated protective structure.

c. Battery Case and Electrical Components

As can be seen with further reference to FIGS. 5–6, the rearward ends of the receptacle and socket 74, 76 extend through an opening 82 in a circular circuit board 84. The circuit board is mounted to an annular, inwardly-projecting flange 86 at the top of the wall 60 of the signal housing, and provides both power and physical support for the LEDs 30 that are mounted to the lower surface thereof.

Also mounted to the flange 86 is a wiring enclosure 88. The wiring enclosure includes a circular top wall 90 and a depending, generally cylindrical outer wall 92. As can be seen, the top wall 90 is spaced above the circuit board 84, so that in combination with the circuit board the enclosure 88 defines a chamber 94 that houses the wiring of the assembly. This includes the wiring that connects the LEDs and main bulb to the battery 96, via an on/off control switch 98 (see FIG. 1), as well as that which connects the battery to a plug receptacle 100 for charging the battery from an external power source, such as a "smart charge" that is capable of charging the battery through its positive and negative terminals. For clarity the wiring and associated connectors, as well as the circuits on the board 84, are not shown in the drawings; it will be understood that is it well within the ability of a person having ordinary skill in the relevant art to construct the necessary circuits using conventional electrical components.

The sidewall 92 of the wiring enclosure includes an annular shoulder 102 that butts against an inwardly-projecting shoulder 104 inside the signal housing 22, so that the shoulder 104 and flange 86 cooperate to position of the wiring enclosure within the assembly. The top wall 90 of the enclosure, in turn, is provided with a central, generally circular contact plate 106 that is surrounded by an annular, ring-shaped contact track 108. As can be seen in FIGS. 5–6, the central plate provides an electrical contact for the positive terminal of the battery 96, while the ring-shaped contact track 108 provides an electrical contact for the negative terminal. An annular wall 112 extends upwardly from the top surface of the wiring enclosure (which is constructed of plastic or other nonconductive material) to provide an added degree of protection between the positive and negative terminals.

The circular and ring shaped configurations of the contact plate and track 106, 108 serve to maintain electrical contact with the terminals of the battery as the signal housing is tightened onto the case 14 by means of cooperating threads 114, 116. The housing can thus be tightened as desired without breaking electrical contact with the battery. An elastomeric (e.g., rubber) O-ring 118 is place over the inner threads 114, and is compressed between cooperating annular faces 120, 122 on the battery case and signal housing so as to form a watertight seal.

The internal threads 116 are formed inside a depending, reinforced bell 124 at the lower end of the main shell 126 of the battery housing. The shell and depending bell are preferably formed unitarily of a durable, electrically insulating material, such as high strength, impact-resistant plastic. The exterior of the shell is preferably provided with light surface texturing (similar to the exterior of the signal housing) for improved handling when working with cold, greasy or wet hands.

The interior of the shell 126 conforms generally to the shape of the battery 96 so as to hold the latter firmly in place. The battery suitably has a generally square, conventional dry-cell configuration, with coil-spring terminals as shown. Due to the reduced drain made possible by the combination of the single incandescent bulb and the LEDs, as described above, a single 6-volt battery will generally be sufficient to operate the lantern for a full night, so that the lantern may be set aside and charged during the day when it is not needed. The shape of the battery holder allows non-rechargeable batteries to be used as well, so that these may be used if desired or as an emergency substitute for the rechargeable battery.

The combination of the threaded connection between the case and signal housing and the circular/ring shaped contact plates and tracks described above provides significant advantages, including the ability to rapidly change batteries when necessary and also the ability to form a durable, watertight seal. However, it will be understood that other forms of connections and means for joining the components may be used in other embodiments. Moreover, it will be understood that the reflector and other components of the signal housing may be employed with any suitable type of battery or case.

d. Bail and Handle Assembly

As can be seen in FIG. 5, first and second reinforced bosses 128*a*, 128*b* are formed on opposite sides of the battery case 12. The bail 16 has inwardly angled lower arms 130*a*, 130*b* that are pivotally mounted to the bosses, by means of threaded studs 132*a*, 132*b* that pass through cooperating bores (not shown) in parallel, flat ears 134*a*, 134*b* at the lower ends of the arms. Self-locking nuts 136*a*, 136*b* secure the arms on the studs, with washers 138*a*, 138*b* and 140*a*, 140*b* being installed between the ears and the bosses/nuts so that the bale can be pivoted and adjusted relative to the battery case as desired.

As can be seen in FIG. 5 and also in FIG. 1, the lower arm portions 130*a*, 130*b* spread outwardly above the mounting ears 134*a*, 134*b* to the lower leg portions 142*a* and 142*b* of the tubular bail 144. The bail 144 is suitably formed of tubular aluminum alloy, with the ends being flattened and bent to form the arms and ears that are mounted to the battery case. The leg portions 142*a*, 142*b* are substantially straight and extend parallel to one another over a length "1" that is selected to be approximately equal to the span occupied by the fingers of a hand when establishing a grip on this portion of the bail; a length "1" of approximately 3-inches is generally suitable. A comparatively large diameter (e.g., about 1-inch) sleeve, preferably formed of rubber or other firm but resiliently yielding material, is installed over at least one of the straight leg portions (leg portion 142*b* in the drawings) to provide an ergonomically superior grip about which the fingers and palm can be curled when holding the lantern in the horizontal orientation, as shown in FIG. 3; when held in this manner, the thumb of the hand is pressed against the thumb rest that is provided by the flat, sloping outer surface of the arm 130*b*, thus stabilizing the lantern and making it far easier to signal than is the case with conventional oval or bow-shaped bails. The thick, resilient sleeve also provides cushioning and thermal insulation to protect the hand from cold and fatigue over a long work shift.

The upper ends of the straight leg portions 142*a*, 142*b* are connected by a curved arch portion 148 of the bail. The arch portion follows a curve having a relatively large radius as compared with other lanterns, which avoids cramping the fingers when the lantern is held in a vertical orientation as shown in FIG. 4, again reducing fatigue and making it easier to handle and signal with the lantern. A second sleeve 150, also formed of a cushioning and thermally insulating material (e.g., rubber), is installed over the arch portion 148 of the bail. As compared with the cushioning sleeve 146 on the vertical leg of the bail, the sleeve 150 has a significantly smaller diameter (approximately ¾-inch); this enables it to rest in the area between the palm and second joint of the fingers so that the bail can be suspended from the hand with the fingers partially curled, thus allowing the lantern to be carried in a vertical orientation with minimal fatigue.

It is to be recognized that various alterations, modifications, and/or additions may be introduced into the constructions and arrangements of parts described above without departing from the spirit or ambit of the present invention as defined by the appended claims.

What is claimed is:

1. A trainman's lantern, comprising:

a reflector comprising inner and outer reflective surfaces;

a primary light source mounted internal to said reflector so that light from said primary light source is reflected by said inner reflective surface so as to project in a generally axial direction from said reflector, said inner reflective surface of said reflector having a generally concave curvature so that said light from said primary light source is reflected in a relatively concentrated beam; and at least one secondary light source mounted external to said reflector so that light from said secondary light source is reflected by said outer reflective surface so as to project in a generally lateral direction from said lantern, said outer reflective surface of said reflector having a generally convex curvature so that said light from said at least one secondary light source is reflected in a relatively dispersed pattern, said at least one secondary light source comprising:

a plurality of LEDs having beams that are directed towards said outer reflective surface of said reflector so as to be reflected in said lateral direction therefrom, said plurality of said LEDs being mounted at spaced locations around said reflector so that said light therefrom is reflected in a substantially radial pattern;

said reflector further comprising:

a plurality of ports formed in said reflector that permit light from said primary source to pass therethrough in a lateral direction so as to augment said light from said at least one secondary source, said plurality of ports being formed in said reflector at spaced locations intermediate said LEDs.

2. The trainman's lantern of claim 1, further comprising:

a substantially transparent housing mounted generally circumferentially around said reflector so as to enclose said LEDs and outer reflective surface of said reflectors therein.

3. The trainman's lantern of claim 2, further comprising:

a plurality of lenses mounted in said ports in said reflector so as to spread light passing therethrough outwardly against and through said transparent shell.

4. The trainman's lantern of claim 3, wherein said transparent shell comprises:

a surface texturing for diffusing said light passing therethrough.

5. The trainman's lantern of claim 1, wherein said inner reflective surface of said reflector comprises a substantially parabolic reflective surface.

6. The trainman's lantern of claim 5, wherein said inner reflective surface of said reflector further comprises:

a non-faceted zone proximate said centrally-mounted incandescent bulb for forming a concentrated central beam; and a faceted zone spaced outwardly from said bulb for forming a distributed illumination around said central beam.

7. The trainman's lantern of claim 1, further comprising:

a battery case having said reflector mounted to a lower end thereof in substantially coaxial relationship.

8. The trainman's lantern of claim 7, further comprising:

a bail mounted to said battery case for holding said lantern alternately in a horizontal or vertical orientation.

9. The trainman's lantern of claim 8, wherein said bail comprises:

first and second substantially straight, parallel lower leg portions for being gripped in a hand when said lantern is held in a horizontal orientation; and a substantially curved upper bow portion connecting said leg portions for being suspended from fingers of a hand when said lantern is held in a vertical orientation.

10. The trainman's lantern of claim 9, wherein said bail further comprises:

first and second substantially flattened arm portions at lower ends of said leg portions that angle inwardly towards said battery case so as to provide a thumb rest for steadying said lantern when said lantern is held in a horizontal orientation.

11. The lantern of claim 10, wherein said bail further comprises:

a cushioning, thermally insulative sleeve that is mounted over at least one of said straight leg portions so as to form an enlarged handgrip for holding said lantern in a horizontal orientation.

12. A trainman's lantern, comprising:

a battery case;

a projector assembly mounted to a lower end of said battery case in substantially coaxial relationship therewith, said projector assembly comprising:

a dome-shaped reflector, comprising a generally concave inner reflective surface and a generally convex outer reflective surface, and a plurality of ports formed at angularly-spaced locations, each of said ports having a lens mounted therein for spreading light passing outwardly therethrough;

a substantially transparent housing mounted circumferentially around said reflector so as to surround said outer reflective surface thereof;

an incandescent bulb mounted centrally with an interior of said reflector so that light from said bulb is reflected from said inner reflective surface of said reflector so as to form a relatively concentrated main beam that is projected generally axially from a lower end of said lantern, said bulb being mounted approximately level with said ports in said reflector so that said light therefrom passes through said lenses in said ports outwardly against and through said transparent housing; and a plurality of LEDs mounted at angularly spaced locations around an exterior of said reflector so that light from said LEDs is reflected from said outer reflective surface of said reflector and thorugh said transparent housing so as to form a secondary illumination that is projected generally laterally and radially from said lower end of said lantern; and a bail mounted to said battery case for selectively holding said lantern in a vertical or horizontal orientation for alternately signaling a locomotive engineer with said main beam or said secondary illumination of the lantern.

13. The trainman's lantern of claim 12, wherein said LEDs are mounted in positions intermediate and alternating with said ports around a perimeter of said reflector.

14. The trainman's lantern of claim 13, wherein said LEDs are mounted so that beams thereof are projected in a generally axial direction against said outer reflective surface of said reflector and are reflected thereby in a generally lateral direction through said transparent housing.

15. The trainman's lantern of claim 14, wherein said bail comprises:

at least one generally straight leg portion for being gripped in a hand when holding said lantern in a generally horizontal orientation; and an upwardly curved bow portion for being suspended from a hand when holding said lantern in a vertical orientation.

16. The lantern of claim 14, wherein said reflector further comprises:

a non-faceted zone proximate said centrally-mounted incandescent bulb for forming a concentrated central beam; and a faceted zone spaced outwardly from said bulb for forming a distributed illumination around said central beam.

* * * * *